United States Patent [19]

Meynard

[11] 4,342,804

[45] Aug. 3, 1982

[54] MICROPOROUS BITUMEN COATED UNDER-ROOFING MATERIAL

[75] Inventor: Jean-Yves Meynard, Mondoubleau, France

[73] Assignee: Siplast S.A., Paris, France

[21] Appl. No.: 190,600

[22] Filed: Sep. 25, 1980

[30] Foreign Application Priority Data

Oct. 18, 1979 [FR] France ..... 79 25891

[51] Int. Cl.[3] ..... B32B 11/10; B32B 11/12; E04D 1/20; E04D 1/22; E04D 5/12

[52] U.S. Cl. ..... 428/149; 427/186; 427/245; 428/150; 428/283; 428/291; 428/308.4; 428/311.1; 428/311.5; 428/315.5

[58] Field of Search ..... 428/149, 150, 283, 291, 428/304, 489, 308.4, 311.1, 311.5, 315.5; 427/186, 245

[56] References Cited

U.S. PATENT DOCUMENTS 3,756,895 9/1973 Bellamy ..... 428/321

*Primary Examiner*—James C. Cannon

*Attorney, Agent, or Firm*—Weiser, Stapler & Spivak

[57] ABSTRACT

This under-roofing material for roofs to be covered with tiles, slates and the like consists of a sheet of agglomerated fibres coated on one face with a layer of bitumen just sufficient for constituting when cooled a micro-perforated structure preventing the passage of liquid by capillarity while permitting the passage or air or vapor, this material having a strength sufficient to withstand the fall of objects or personnel during its use, and being essentially liquid-tight and pervious to air and vapors.

6 Claims, No Drawings

MICROPOROUS BITUMEN COATED UNDER-ROOFING MATERIAL

BACKGROUND OF THE INVENTION

The present invention relates to under-roofing materials and has specific reference to a material of this kind intended for covering the roof structure and receiving the ultimate or topmost roofing material, and consisting of elements assembled in overlapping relationship, which are impervious to water, snow or ice, and pervious to air or vapor.

It is known to those conversant with the art that roofs covered with roofing materials made of discrete elements must be isolated and protected against the penetration of water and, snow.

These discrete elements may consist of tiles, slates, or any other reliable weatherproof materials, their imperviousness resulting from their mutual overlapping in the fashion of fish scales.

As a rule, this under-roofing material is disposed between the tile support means and the framework.

Hitherto known under-roofing materials are perfectly tight, notably in the case of plastic films or tarred felt sheets.

However, plastics material and other materials such as impregnated cellulose sheets have neither the porosity required to enable the roof to "breath" while preserving a satisfactory water-tightness, nor the strength necessary to permit their use in roof construction without any danger for the roofer or tiler.

On the other hand, for reasons of economy and low-weight requirements, these materials have moderate mechanical properties involving a certain handling risk for the roofer.

This double problem will be better understood from the following two illustrative examples:

1. One of the materials utilized is a polyethylene film. This perfectly fluid-tight film, though preventing any water from penetrating into the building, will retain this water between the framework and the tile support means. Consequently, since the roof cannot "breath" the tile supports are liable to rot after a relatively short time, unless the user perforates the polyethylene film at many places for restoring the air circulation, but in this case the protection against the penetration of water is lost.

2. When used by the roofer this material is attended by certain handling dangers. In fact, when fitting the battens, the roofer cannot see the frame, so that he cannot locate with precision the bearing points on which he can walk, and therefore he runs the risk of falling through the roof.

The French Pat. No. 2,098,475 discloses a roofing insulation strip consisting of thermoplastic filaments or fibres heated to provide the necessary water-tightness while allowing the passage of air therethrough.

The U.S. Pat. No. 3,756,895 also describes a roof covering consisting of several layers of glass fibres associated with a microporous surface layer or membrane consisting of polyester and polyurethane fibres.

SUMMARY OF THE INVENTION

The present invention is directed to provide an under-roofing material which is both impervious to liquid or solidified water and pervious to air and water vapor, while having a strength sufficient to withstand the fall of objects or personnel during its use.

This under-roofing material comprises a sheet made of fibres agglomerated through conventional means, such as unwoven polyester, unwoven polypropylene, unwoven polyethylene fibres (this selection being given by way of example, not of limitation), this sheet being subsequently coated on one face only, and by using conventional means, with a very thin microporous bitumen layer having characteristics differing completely from those of the thermoplastic fibres used in the prior art technique.

The coating process as well as the bitumen grade are adjusted to limit the quantity of product to just the amount necessary to blacken the unwoven material so that, during the shrinking of the bitumen during the cooling thereof, of a micro-crackled and micro-perforated surface will be obtained to impart to the composite material on the one hand the desired perviousness to air and water vapor and on the other hand the desired water-tightness.

In fact, the holes thus formed through the under-roofing material are on the one hand too small to permit the passage of water therethrough, due to the water surface tension, and on the other hand large enough and sufficient in number to permit the free passage of air and water vapor either ways through the sheet.

The surprising aspect of the present invention lies in this association of an unwoven material with a quantity of bitumen sufficient to obtain a continuous yet perforated surface, which is the opposite of the effect sought by conventional users of these materials, i.e. a complete fluid-tightness.

EXAMPLES

1. The under-roofing material comprises an unwoven polypropylene sheet weighing 135 grammes per square meter, having one face coated with 300 grammes of 90/30 bitumen, the bituminous face being protected by a roughing agent such as sandstone, talc, sand, or the like, excluding plastic films.

2. The under-roofing material comprises an unwoven sheet of polyester weighing 85 grammes per sq. m., coated on one face with 250 g/sq.m. of 90/30 fillerized bitumen, protected by sandstone grit.

3. The under-roofing material consisting of an unwoven sheet of polyvinyl fibres weighing 200 gr/sq.m., coated on one face with 250 gr/sq.m. of 90/30 fillerized bitumen protected by sandstone grit.

What is claimed as new is:

1. A water-tight and air- or air-vapor pervious under-roofing material for roofings made of discrete elements such as overlapping tiles, slates or the like, which comprises a sheet of agglomerated fibres, wherein said sheet is coated on its outer surface with a film of bitumen constituting an amount just sufficient for constituting when cooled a micro-perforated or micro-crackled structure preventing the passage of liquid by capillarity therethrough while permitting the passage of air or vapor.

2. The roofing material of claim 1, wherein said fibre sheet consists of an unwoven polyester structure.

3. The roofing material of claim 1, wherein said fibre sheet consists of an unwoven polypropylene structure.

4. The roofing material of claim 1, wherein said fibre sheet consists of an unwoven polyethylene structure.

5. The roofing material of claim 1, wherein said fibre sheet consists of an unwoven polyvinyl fibre structure.

6. The roofing material of claim 1, wherein said bitumen film is protected by a roughing agent selected from the group comprising sandstone, talc and sand.

* * * * *